United States Patent [19]

Chen

[11] 3,967,954

[45] July 6, 1976

[54] PRE-LEACHING OR REDUCTION TREATMENT IN THE BENEFICIATION OF TITANIFEROUS IRON ORES

[75] Inventor: James H. Chen, Corpus Christi, Tex.

[73] Assignee: Benilite Corporation of America, New York, N.Y.

[22] Filed: Sept. 10, 1974

[21] Appl. No.: 504,829

Related U.S. Application Data

[63] Continuation of Ser. No. 132,806, April 9, 1971, abandoned.

[52] U.S. Cl. ..... 75/1 T; 75/21; 75/101 R

[51] Int. Cl.[2] ..... C22B 1/00

[58] Field of Search ..... 75/1, 21, 101

[56] References Cited

UNITED STATES PATENTS

| | | | |
|---|---|---|---|
| 3,450,523 | 6/1969 | Socolescu | 75/21 |
| 3,457,037 | 7/1969 | Aramendia | 75/1 |
| 3,649,243 | 3/1972 | Williams | 75/1 |
| 3,660,029 | 5/1972 | Naguib | 75/101 R |
| 3,677,740 | 7/1972 | Williams | 75/1 |
| 3,753,686 | 8/1973 | Wilder | 75/21 |
| 3,764,651 | 10/1973 | Henkel | 75/1 |
| 3,803,287 | 4/1974 | Fukushima | 75/1 |

*Primary Examiner*—Peter D. Rosenberg
*Attorney, Agent, or Firm*—Brumbaugh, Graves, Donohue & Raymond

[57] ABSTRACT

The purity of titanium dioxide obtained by the acid leaching of a titaniferous iron ore, such as ilmenite, is improved by heating the ore prior to acid leaching with a reducing agent mixture of (a) a carbonaceous reducing agent and/or hydrogen and (b) sulfur to convert and lower the ferric oxide contaminant content of the ore to acid-soluble ferrous oxide and ferrous sulfide.

7 Claims, No Drawings

PRE-LEACHING OR REDUCTION TREATMENT IN THE BENEFICIATION OF TITANIFEROUS IRON ORES

This is a continuation application of U.S. application Ser. No. 132,806, filed Apr. 9, 1971, now abandoned.

Beneficiation of ilmenite is a process for up-grading ilmenite, which contains approximately 40% to 70% by weight of titanium dioxide ($TiO_2$) and 25% to 55% by weight of iron oxides, to a product containing 90% by weight or more titanium dioxide usually called "Beneficiated Ilmenite" or "Synthetic Rutile."

One method for the beneficiation of ilmenite is by acid leaching. The iron oxides in the ilmenite are substantially removed by leaching the ilmenite with a mineral acid, such as hydrochloric acid, sulfuric acid, etc.

Usually, the iron oxides in the ilmenite are present in both ferric and ferrous forms. Some ores contain high percentages of ferric oxide ($Fe_2O_3$), and some, ferrous oxide (FeO). It is known that iron oxide in ferrous form is more easily extracted by a mineral acid than the ferric form. Therefore, by chemically reducing iron oxide in the ferric form in the ilmenite to the ferrous form the subsequent acid leaching process can be carried out more effectively.

The chemical reduction can be accomplished by conventional methods, using carbonaceous reducing agents, such as petroleum coke, coal, charcoal, fuel oil, etc. The cabonaceous reducing agent is mixed with the ilmenite and heated at a temperature of from about 1500°F. to about 2000°F. in a reduction furnace or a rotary kiln whereby a substantial portion of the ferric oxide is reduced to ferrous oxide.

However, not all types of ilmenite can be effectively leached or beneficiated after reduction with a carbonaceous reducing agent. As an example, two types of ilmenite, both from the U.S.A., with substantially the same chemical analysis were reduced by heating with petroleum coke followed by leaching with hydrochloric acid. One yielded a beneficiated product containing 91.65% by weight $TiO_2$ while the other yielded a product containing only 73.50% by weight $TiO_2$.

The present invention relates to a new and improved method of pre-leaching or reduction treatment by which ilmenites or other titaniferous iron ores which do not respond satisfactorily to conventional reduction methods followed by acid leaching can be successfully beneficiated by subsequent acid leaching. For such raw materials which do respond satisfactorily to conventional reduction methods, even better beneficiated products can be obtained by using this new and improved pre-leaching or reduction method.

In accordance with the new and improved method of this invention the titaniferous iron ore, such as ilmenite, is heated (prior to the leaching thereof with a mineral acid, such as hydrochloric acid, sulfuric acid, etc.) with a reducing agent mixture of (a) a cabonaceous reducing agent and/or hydrogen and (b) sulfur. Such reduction converts and lowers the ferric oxide contaminant content of the raw material to acid-soluble ferrous oxide and ferrous sulfide. The time and temperature of heating will vary somewhat with the nature of the reducing agent mixture and the raw material being reduced. The heating is conducted generally at a temperature of from about 1500°F. to about 2000°F. and usually for a time of from about 10 minutes to about 60 minutes. The time of heating is generally inversely related to the temperature at which the heating is conducted.

The carbonaceous reducing agent can be a solid, such as petroleum coke, coal or charcoal; or a liquid, such as fuel oil; or a gas, such as carbon monoxide, methane or natural gas. Hydrogen gas alone or in admixture with the cabonaceous reducing agent can also be used. The hydrogen and/or cabonaceous reducing agent is used in an amount of from about 3% to about 5% by weight based on the weight of the raw material to be reduced. The sulfur is employed in an amount from about 0.2% to about 2% by weight based on the weight of the raw material to be reduced. The amount of sulfur employed or added in elemental form, for the sake of economy, can take into consideration any small amount of sulfur which may be present as an impurity in the cabonaceous reducing agent and hence may be correspondingly reduced by that amount.

As noted above, during the reduction step, the ferric oxide contaminant content of the raw material is converted and lowered to acid-soluble ferrous oxide and ferrous sulfide. It is theorized that due to the much higher atomic volume of sulfur (25.6 cc./gram-atom) than oxygen (7.4 cc./gram-atom) the formation of small amounts of ferrous sulfide may expand and effectively open up the crystal lattice structure of the raw material, such as ilmenite, and thereby make the subsequent acid leaching step much easier and more complete.

In connection with the pre-leaching or reduction step of the invention, it is important to prevent the reduced raw material, such as ilmenite, from reoxidation after discharging it from the reducing furnace. The red-hot reduced raw material from the reducing furnace must be prevented from contacting with air which would cause reoxidation. It was found that reoxidation of the hot ferrous iron to ferric iron by air contact can be prevented by cooling the reduced raw material down to a temperature of about 500°F. or lower very rapidly either in a water tube cooler in direct contact with a cold metal surface or by quenching it with water. The water can be sprayed directly onto the red-hot reduced raw material and flash evaporated as soon as it comes out from the reducing furnace or kiln or the red-hot reduced raw material can be immersed in a water bath. A combination of these rapid cooling means can also be used.

The acid leaching and separation steps which follow the pre-treatment or reduction step of the invention can be any of the conventional or well known operations therefor and hence they form no part of the present invention. A particularly suitable procedure of acid leaching and separation is described in my copending U.S. application Ser. No. 866,548, filed Oct. 15, 1969, the disclosure of which is hereby incorporated by reference herein.

The process of the invention will be further illustrated by the following representative examples thereof.

EXAMPLE 1

An ilmenite ore from the United States had the following wt. % analysis:

Table I

| Components | % by Weight |
|---|---|
| $TiO_2$ | 67.17 |
| $Fe_2O_3$ | 26.10 |

Table I-continued

| Components | % by Weight |
|---|---|
| FeO | 1.87 |
| Others | Balance |
| TOTAL | 100.00 |

As a comparative or control run (Run 1), the ilmenite ore was mixed with 5% by weight thereof of petroleum coke and heated at about 1650°F. for 30 minutes. Thereafter, it was rapidly cooled down to a temperature of 500°F. or less by quenching it through immersion in a water bath.

In a representative run of the process of the invention (Run 2), the ilmenite ore was mixed with 5% by weight thereof of petroleum coke and 2% by weight thereof of sulfur and heated at about 1650°F. for 30 minutes. Thereafter, it was rapidly cooled down to a temperature of 500°F. or less by quenching it through immersion in a water bath.

The reduced ilmenite had the following wt. % analysis:

Table II

| Components | % by Weight Run 1 (Reduced with Petroleum Coke) | Run 2 (Reduced with Petroleum Coke and Sulfur) |
|---|---|---|
| $TiO_2$ | 68.80 | 68.45 |
| $Fe_2O_3$ | 7.35 | 5.53 |
| FeO | 17.57 | 17.17 |
| FeS | 0.47 | 2.55 |
| Others | Balance | Balance |
| TOTAL | 100.00 | 100.00 |

In each run, the reduced and cooled ilmenites were separately leached with a mineral acid in two successive stages. In the first stage 1.4 parts by weight of 20% hydrochloric acid per part by weight of ilmenite was used while in the second stage 1.2 parts by weight of 20% hyrochloric acid per part by weight of ilmenite was used. In each of the two stages, the leaching was conducted under a pressure of 14 to 20 psig. and at a temperature of 230°F. to 275°F. for 4 hours per stage.

After separation of the acid-soluble contaminant values from the acid-insoluble titanium values and drying of the titanium values, the beneficiated ilmenite had the following wt. % analysis:

Table III

| Components | % by Weight Run 1 (Reduced with Petroleum Coke) | Run 2 (Reduced with Petroleum Coke and Sulfur) |
|---|---|---|
| $TiO_2$ | 73.50 | 92.17 |
| $Fe_2O_3$ | 21.80 | 2.72 |
| FeO | 0.20 | 0.20 |
| FeS | None | None |
| Others | Balance | Balance |
| TOTAL | 100.00 | 100.00 |

The above example is illustrative of the processing of an ilmenite ore which cannot be satisfactorily beneficiated by heating it with a carbonaceous reducing agent alone (petroleum coke) followed by an acid leach (comparative or control Run 1). Thus the raw ilmenite ore contained 67.17% by weight of $TiO_2$ and 27.97% by weight of ferric oxide plus ferrous oxide, while the beneficiated ilmenite contained only 73.50% by weight of $TiO_2$ and still contained a high contaminant content of 22.00% by weight of ferric oxide plus ferrous oxide. However, when this same ilmenite ore was beneficiated by reducing it in accordance with the process of the invention using a reducing agent mixture of petroleum coke and sulfur (Run 2) followed by an acid leach, the purity of the beneficiated ilmenite was markedly and unexpectedly increased, i.e., the $TiO_2$ content was increased from 67.17% by weight to 92.17% by weight and the contaminant content of ferric oxide plus ferrous oxide was reduced from a high value of 27.97% by weight to a low value of only 2.92% by weight.

EXAMPLE 2

An ilmenite ore from Australia had the following wt. % analysis:

Table IV

| Components | % by Weight |
|---|---|
| $TiO_2$ | 53.43 |
| $Fe_2O_3$ | 17.90 |
| FeO | 25.03 |
| Others | Balance |
| TOTAL | 100.00 |

As a comparative or control run (Run 3), the ilmenite ore was mixed with 5% by weight thereof of Bunker C fuel oil and heated at about 1560°F. for 30 minutes. Thereafter, it was rapidly cooled down to a temperature of 500°F. or less by quenching it through immersion in a water bath.

In a representative run of the process of the invention (Run 4), the ilmenite ore was mixed with 5% by weight thereof of Bunker C fuel oil and 1% by weight thereof of sulfur and heated at about 1560°F. for 30 minutes. Thereafter, it was rapidly cooled down to a temperature of 500°F. or less by quenching it through immersion in a water bath.

The reduced ilmenite had the following wt. % analysis:

Table V

| Components | % by Weight Run 3 (Reduced with Bunker C Fuel Oil) | Run 4 (Reduced with Bunker C Fuel Oil and Sulfur) |
|---|---|---|
| $TiO_2$ | 54.30 | 54.02 |
| $Fe_2O_3$ | 6.29 | 5.15 |
| FeO | 33.74 | 33.14 |
| FeS | 0.58 | 1.89 |
| Others | Balance | Balance |
| TOTAL | 100.00 | 100.00 |

The reduced and cooled ilmenites of Runs 3 and 4 were separately leached with a mineral acid in two successive stages. In the first stage, 1.6 parts by weight of 20% hydrochloric acid per part by weight of ilmenite was used while in the second stage 1.4 parts by weight of 20% hydrochloric acid per part by weight of ilmenite was used. The leaching in each of the two stages was conducted under a pressure of 15 to 20 psig. and at a temperature of 230°F. to 250°F. for 4 hours per stage.

After separation of the acid-soluble contaminant values from the acid-insoluble titanium values and drying of the titanium values, the beneficiated ilmenite had the following wt. % analysis:

Table VI

| Components | % by Weight Run 3 (Reduced with Bunker C Fuel Oil) | Run 4 (Reduced with Bunker C Fuel Oil and Sulfur) |
|---|---|---|
| $TiO_2$ | 94.68 | 96.71 |
| $Fe_2O_3$ | 3.51 | 2.23 |
| FeO | 0.25 | 0.20 |
| FeS | None | None |
| Others | Balance | Balance |
| TOTAL | 100.00 | 100.00 |

In this example the ilmenite ore was of a type which could be satisfactorily beneficiated by heating it with a carbonaceous reducing agent alone (Bunker C fuel oil) followed by acid leaching (comparative or control Run 3). However, it will be noted that even with this type of ilmenite ore the use of the reducing agent mixture of a carbonaceous reducing agent and sulfur followed by acid leaching further improved the purity of the beneficiated ilmenite product (Run 4 of the invention) over that obtained using a carbonaceous reducing agent alone (comparative or control Run 3).

It will be appreciated that various modifications and changes may be made in the process of the invention in addition to those set forth hereinabove by those skilled in the art without departing from the essence of the invention and that accordingly the invention is to be limited only within the scope of the appended claims.

What is claimed is:

1. In a process for the beneficiation of titaniferous iron ores which comprises the steps of 1. heating said raw material at a temperature of from about 1500°F. to about 2000°F. for from about 10 minutes to about 60 minutes with a reducing agent mixture of
   a. from about 3% to about 5% by weight based upon the weight of the raw material of a cabonaceous reducing agent or hydrogen or mixtures thereof and
   b. from about 0.2% to about 2% by weight based on the weight of the raw material of solid elemental sulfur to convert and lower the ferric oxide contaminant content of the raw material to acid-soluble ferrous oxide and ferrous sulfide, the latter in small amount,
2. rapidly cooling down the reduced raw material to a temperature of about 500°F. or lower out of contact with air to prevent reoxidation of the ferrous iron compounds to ferric iron compounds,
3. leaching the cooled and reduced raw material with a mineral acid leach liquor to provide a waste leach liquor containing acid-soluble iron contaminant values and acid-insoluble titanium values, and
4. separating these values from one another, the improvement which comprises said step (2) being performed by a procedure selected from the group consisting of
   a. quenching the reduced raw material with water,
   b. spraying water directly onto the reduced raw material,
   c. immersing the reduced raw material in a water bath, and
   d. passing the reduced raw material through a water tube cooler in direct contact with a cold metal surface;

whereby the purity of the beneficiated titanium dioxide product of the process is increased.

2. The process as defined in claim 1 wherein said step (2) is performed by (a) quenching the reduced raw material with water.

3. The process as defined in claim 1 wherein said step (2) is performed by (b) spraying water directly onto the reduced raw material.

4. The process as defined in claim 1 wherein said step (2) is performed by (c) immersing the reduced raw material in a water bath.

5. The process as defined in claim 1 wherein said step (2) is performed by (d) passing the reduced material through a water tube cooler in direct contact with a cold metal surface.

6. The process as defined by claim 1 wherein the titaniferous iron ore is ilmenite.

7. The process as defined in claim 6 wherein the carbonaceous reducing agent is petroleum coke or fuel oil.

* * * * *